US008226312B2

(12) United States Patent
Rennecker et al.

(10) Patent No.: US 8,226,312 B2
(45) Date of Patent: Jul. 24, 2012

(54) VALVE DOOR HAVING A FORCE DIRECTING COMPONENT AND RETRACTABLE INSTRUMENTS COMPRISING SAME

(75) Inventors: Daniel Rennecker, Chicago, IL (US); Russ Vanderhoof, Joliet, IL (US)

(73) Assignee: Sanford, L.P., Oak Brook, IL (US)

( * ) Notice: Subject to any disclaimer, the term of this patent is extended or adjusted under 35 U.S.C. 154(b) by 1153 days.

(21) Appl. No.: 12/057,477

(22) Filed: Mar. 28, 2008

(65) Prior Publication Data

US 2009/0245919 A1 Oct. 1, 2009

(51) Int. Cl.
*B43K 5/17* (2006.01)

(52) U.S. Cl. ..... 401/108; 401/107

(58) Field of Classification Search ..... 401/107, 401/108; 220/694, 729, 735
See application file for complete search history.

(56) References Cited

U.S. PATENT DOCUMENTS

| | | | | |
|---|---|---|---|---|
| 1,810,249 | A | | 6/1931 | Koehler |
| 1,940,548 | A | | 12/1933 | Jensen |
| 2,240,992 | A | * | 5/1941 | Landau ..... 401/108 |
| 2,291,859 | A | | 8/1942 | Andrews |
| 2,392,840 | A | | 1/1946 | Groft |
| 2,401,711 | A | | 6/1946 | Smith |
| 2,603,186 | A | | 7/1952 | Fischer |
| 2,626,049 | A | | 1/1953 | Tursky |
| 2,874,679 | A | | 2/1959 | Zepelovitch |
| 2,949,887 | A | | 8/1960 | Martin et al. |
| 2,957,452 | A | | 10/1960 | Brannon |
| 3,035,299 | A | | 5/1962 | Gordon et al. |
| 3,124,106 | A | | 3/1964 | Kosta |
| 3,146,758 | A | | 9/1964 | Zepell |
| 3,169,511 | A | | 2/1965 | Spatz |
| 3,480,370 | A | | 11/1969 | Koeln |
| 3,525,573 | A | | 8/1970 | Fend |
| 3,583,820 | A | | 6/1971 | Koeln |
| 3,594,091 | A | | 7/1971 | Bleuer |
| 3,617,138 | A | | 11/1971 | Fukui et al. |
| 3,637,316 | A | | 1/1972 | Bross et al. |
| 3,733,139 | A | | 5/1973 | Neidhardt et al. |
| 3,813,176 | A | | 5/1974 | Kamo |

(Continued)

FOREIGN PATENT DOCUMENTS

DE 34 38 074 7/1986

(Continued)

OTHER PUBLICATIONS

International Search Report and Written Opinion for Application No. PCT/US2009/035382, dated Jun. 22, 2009.

(Continued)

*Primary Examiner* — Dinh Q Nguyen
*Assistant Examiner* — Viet Le
(74) *Attorney, Agent, or Firm* — Marshall, Gerstein & Borun LLP

(57) ABSTRACT

A valve door for a seal cylinder comprises a lid having first and second surfaces and a connecting means connecting the lid with an actuating mechanism, the connecting means distributes forces from the actuating mechanism across a portion of the first lid surface in order to bias the lid to a closed position. A force directing member is attached to the first lid surface, the force directing member being adapted to distribute force from the connecting means over a portion of the lid surface, thereby maintaining a positive seal and reducing lid deflection.

18 Claims, 7 Drawing Sheets

U.S. PATENT DOCUMENTS

| | | | | |
|---|---|---|---|---|
| 3,895,632 | A | | 7/1975 | Plowiecki et al. |
| 3,941,488 | A | | 3/1976 | Maxwell |
| 3,944,371 | A | | 3/1976 | Schenk |
| 3,945,734 | A | | 3/1976 | Woodbridge |
| 3,955,893 | A | | 5/1976 | Pulaski |
| 3,985,455 | A | | 10/1976 | Wahlberg |
| 4,022,535 | A | | 5/1977 | Ritter |
| 4,115,015 | A | | 9/1978 | Torii et al. |
| 4,161,374 | A | | 7/1979 | Koeln et al. |
| 4,177,814 | A | | 12/1979 | Knepshield et al. |
| 4,218,154 | A | | 8/1980 | Erfer |
| 4,221,490 | A | | 9/1980 | Malm |
| 4,269,525 | A | | 5/1981 | Melikian |
| 4,315,695 | A | | 2/1982 | Alves dos Santos et al. |
| 4,318,340 | A | | 3/1982 | Shenoha et al. |
| 4,469,462 | A | | 9/1984 | Hashimoto et al. |
| 4,479,732 | A | | 10/1984 | Shimizu et al. |
| 4,533,271 | A | | 8/1985 | Sansevero |
| 4,540,300 | A | | 9/1985 | Midorikawa et al. |
| 4,549,827 | A | | 10/1985 | Mack |
| 4,560,297 | A | | 12/1985 | Leem et al. |
| 4,575,271 | A | | 3/1986 | Hashimoto et al. |
| 4,580,918 | A | | 4/1986 | Baker et al. |
| 4,618,280 | A | | 10/1986 | Kageyama et al. |
| 4,629,348 | A | | 12/1986 | Hashimoto et al. |
| 4,711,592 | A | | 12/1987 | Gregory |
| 4,738,724 | A | | 4/1988 | Wittwer et al. |
| 4,738,817 | A | | 4/1988 | Wittwer et al. |
| 4,759,650 | A | | 7/1988 | Granoff |
| 4,768,529 | A | | 9/1988 | Mahruki et al. |
| 4,812,299 | A | | 3/1989 | Wason |
| 4,815,881 | A | | 3/1989 | Chern |
| 4,859,103 | A | | 8/1989 | Wittek et al. |
| 4,863,796 | A | | 9/1989 | Wason |
| 4,879,058 | A | | 11/1989 | Wason |
| 4,879,323 | A | | 11/1989 | Wason |
| 4,896,983 | A | | 1/1990 | Im et al. |
| 4,902,657 | A | | 2/1990 | Wason |
| 4,902,729 | A | | 2/1990 | Wason |
| 4,904,101 | A | | 2/1990 | Petterson |
| 4,911,570 | A | | 3/1990 | Rhoades |
| 4,933,387 | A | | 6/1990 | Wason |
| 4,937,078 | A | | 6/1990 | Mezei et al. |
| 4,954,468 | A | | 9/1990 | Wason |
| 4,968,728 | A | | 11/1990 | Wason |
| 4,969,764 | A | | 11/1990 | Gregory |
| 4,974,980 | A | | 12/1990 | Gueret et al. |
| 5,015,111 | A | | 5/1991 | Petterson |
| 5,022,773 | A | | 6/1991 | Waldinger et al. |
| 5,026,189 | A | | 6/1991 | Keil et al. |
| 5,048,990 | A | * | 9/1991 | Hashimoto et al. ..... 401/107 |
| 5,090,955 | A | | 2/1992 | Simon |
| D324,542 | S | | 3/1992 | Lin |
| 5,092,701 | A | | 3/1992 | Lai et al. |
| 5,174,814 | A | | 12/1992 | Burwell et al. |
| 5,184,908 | A | | 2/1993 | Yamamoto et al. |
| 5,207,523 | A | | 5/1993 | Wittek |
| 5,336,006 | A | | 8/1994 | Badr et al. |
| 5,342,135 | A | | 8/1994 | Tucker |
| 5,342,136 | A | | 8/1994 | Fukami et al. |
| 5,358,864 | A | | 10/1994 | van den Broeck et al. |
| 5,372,580 | A | | 12/1994 | Simon et al. |
| 5,420,615 | A | | 5/1995 | Witz et al. |
| 5,426,456 | A | | 6/1995 | Kuelzer et al. |
| 5,439,626 | A | | 8/1995 | Bennett et al. |
| 5,454,655 | A | | 10/1995 | Chiswell |
| 5,517,218 | A | | 5/1996 | Lehna et al. |
| 5,547,301 | A | | 8/1996 | Kageyama et al. |
| 5,547,468 | A | | 8/1996 | Simon et al. |
| 5,553,956 | A | | 9/1996 | Mitsuya et al. |
| 5,599,122 | A | | 2/1997 | Yu |
| 5,604,036 | A | | 2/1997 | Price et al. |
| 5,605,402 | A | | 2/1997 | Uggetti et al. |
| 5,607,437 | A | | 3/1997 | Simon et al. |
| 5,610,046 | A | | 3/1997 | van Ooyen et al. |
| 5,643,660 | A | | 7/1997 | Price et al. |
| 5,651,627 | A | | 7/1997 | Dowzall et al. |
| 5,653,725 | A | | 8/1997 | Simon et al. |
| 5,672,021 | A | | 9/1997 | Abber et al. |
| 5,676,481 | A | | 10/1997 | Nicoll et al. |
| 5,727,893 | A | | 3/1998 | Handler |
| 5,813,787 | A | | 9/1998 | Dowzall et al. |
| 5,823,697 | A | | 10/1998 | Talbot et al. |
| D400,581 | S | | 11/1998 | Hasegawa |
| 5,829,904 | A | | 11/1998 | Matsumoto et al. |
| 5,849,559 | A | | 12/1998 | Van Der Wouw et al. |
| 5,855,442 | A | | 1/1999 | Keller |
| 5,865,553 | A | | 2/1999 | Flye Sainte Marie et al. |
| 5,871,294 | A | | 2/1999 | Turner |
| 5,871,296 | A | | 2/1999 | Furukawa et al. |
| 5,891,398 | A | | 4/1999 | Lewis et al. |
| 5,899,618 | A | | 5/1999 | Kobayashi et al. |
| 5,906,446 | A | | 5/1999 | McCulloch et al. |
| 5,915,867 | A | | 6/1999 | Hashimoto et al. |
| 5,927,881 | A | | 7/1999 | Yang |
| 5,927,882 | A | | 7/1999 | Kageyama et al. |
| 5,927,883 | A | | 7/1999 | Lebauer |
| 5,929,051 | A | | 7/1999 | Ni et al. |
| 5,931,846 | A | | 8/1999 | Simon et al. |
| 5,938,360 | A | | 8/1999 | Yen et al. |
| 5,957,603 | A | | 9/1999 | Bell |
| 5,961,703 | A | | 10/1999 | Fraas et al. |
| 5,967,688 | A | | 10/1999 | Hu et al. |
| D417,206 | S | | 11/1999 | Hirota |
| 6,019,535 | A | | 2/2000 | Turner |
| 6,027,271 | A | | 2/2000 | Barosso et al. |
| 6,033,141 | A | | 3/2000 | Blaustein et al. |
| 6,048,121 | A | | 4/2000 | Carver |
| 6,066,356 | A | | 5/2000 | Van Der Wouw et al. |
| 6,089,776 | A | | 7/2000 | Kaufmann et al. |
| 6,095,707 | A | | 8/2000 | Kaufmann et al. |
| 6,099,924 | A | | 8/2000 | Nakamaki et al. |
| 6,106,179 | A | | 8/2000 | Kuo |
| 6,120,204 | A | | 9/2000 | Rigoni |
| 6,120,751 | A | | 9/2000 | Unger |
| 6,135,659 | A | | 10/2000 | Ku et al. |
| 6,135,660 | A | | 10/2000 | Stevens et al. |
| 6,155,733 | A | | 12/2000 | Holbrook et al. |
| 6,158,913 | A | | 12/2000 | Dumler et al. |
| 6,170,318 | B1 | | 1/2001 | Lewis |
| 6,213,661 | B1 | | 4/2001 | Coon |
| 6,231,257 | B1 | | 5/2001 | Stevens et al. |
| 6,244,744 | B1 | | 6/2001 | Calvin |
| 6,244,774 | B1 | | 6/2001 | Barosso et al. |
| 6,261,019 | B1 | | 7/2001 | Furukawa et al. |
| 6,306,598 | B1 | | 10/2001 | Charych et al. |
| 6,347,898 | B1 | | 2/2002 | Rhodes et al. |
| 6,350,369 | B1 | | 2/2002 | Lewis et al. |
| 6,371,673 | B1 | | 4/2002 | Gueret |
| D457,185 | S | | 5/2002 | Ham |
| 6,409,408 | B2 | | 6/2002 | Koyama et al. |
| D460,484 | S | | 7/2002 | Bianco, Jr. |
| D460,982 | S | | 7/2002 | Bianco, Jr. |
| 6,416,242 | B1 | | 7/2002 | Kaufmann et al. |
| 6,417,121 | B1 | | 7/2002 | Newkirk et al. |
| 6,417,122 | B1 | | 7/2002 | Newkirk et al. |
| 6,420,285 | B1 | | 7/2002 | Newkirk et al. |
| 6,433,012 | B1 | | 8/2002 | Tuse et al. |
| 6,468,759 | B1 | | 10/2002 | Charych |
| D466,213 | S | | 11/2002 | Snitkin et al. |
| 6,478,495 | B2 | | 11/2002 | Ami et al. |
| 6,482,517 | B1 | | 11/2002 | Anderson |
| 6,505,984 | B2 | | 1/2003 | Smith et al. |
| D471,233 | S | | 3/2003 | Geiselhart et al. |
| D472,578 | S | | 4/2003 | Plantz et al. |
| 6,540,422 | B2 | | 4/2003 | Torii |
| 6,554,516 | B1 | | 4/2003 | Christopher |
| 6,554,517 | B2 | | 4/2003 | Ahmed |
| 6,561,713 | B2 | | 5/2003 | Sukhna et al. |
| 6,565,275 | B2 | | 5/2003 | Brand et al. |
| 6,565,763 | B1 | | 5/2003 | Asakawa et al. |
| 6,588,958 | B1 | | 7/2003 | Seidler |
| 6,605,344 | B1 | | 8/2003 | Ohba et al. |
| 6,607,325 | B2 | | 8/2003 | Hori et al. |
| 6,631,333 | B1 | | 10/2003 | Lewis et al. |
| 6,638,621 | B2 | | 10/2003 | Anderson |
| 6,644,880 | B2 | | 11/2003 | Duez et al. |

| | | | |
|---|---|---|---|
| 6,648,539 | B2 | 11/2003 | Dai et al. |
| 6,656,319 | B1 | 12/2003 | Boyd et al. |
| D487,113 | S | 2/2004 | Kent |
| D489,087 | S | 4/2004 | Kent |
| 6,723,394 | B1 | 4/2004 | Sirringhaus et al. |
| 6,752,557 | B1 | 6/2004 | Hsieh et al. |
| 6,755,584 | B2 | 6/2004 | O'Brien et al. |
| D497,180 | S | 10/2004 | Cetera |
| D497,387 | S | 10/2004 | Cetera |
| D501,509 | S | 2/2005 | Lecce |
| 6,927,256 | B2 | 8/2005 | Stevens et al. |
| 6,964,534 | B2 | 11/2005 | Brand et al. |
| 6,967,102 | B1 | 11/2005 | Anderson et al. |
| 6,974,697 | B2 | 12/2005 | Comer et al. |
| 6,977,244 | B2 | 12/2005 | Tormo et al. |
| 6,979,456 | B1 | 12/2005 | Parikh et al. |
| 6,979,558 | B2 | 12/2005 | Harris, Jr. et al. |
| 6,979,559 | B2 | 12/2005 | Harris, Jr. et al. |
| 6,981,812 | B1 | 1/2006 | Hsieh et al. |
| 6,989,007 | B2 | 1/2006 | Shadduck |
| 6,989,195 | B2 | 1/2006 | Anderson |
| 6,991,514 | B1 | 1/2006 | Meloni et al. |
| 7,004,945 | B2 | 2/2006 | Boyd et al. |
| 7,008,633 | B2 | 3/2006 | Yang et al. |
| 7,018,838 | B2 | 3/2006 | Murphy et al. |
| 7,022,683 | B1 | 4/2006 | Ni et al. |
| 7,037,015 | B1 | 5/2006 | Witz et al. |
| 7,037,657 | B2 | 5/2006 | Le et al. |
| 7,048,963 | B2 | 5/2006 | Braithwaite et al. |
| 7,059,796 | B2 | 6/2006 | Lewis, Jr. et al. |
| 7,060,754 | B2 | 6/2006 | Stevens et al. |
| 7,101,102 | B2 | 9/2006 | Sawa et al. |
| 7,220,073 | B2 | 5/2007 | Yoon et al. |
| 7,252,449 | B2 | 8/2007 | Carroll |
| 7,255,507 | B2 | 8/2007 | Lammers et al. |
| 7,329,062 | B2 | 2/2008 | Brand et al. |
| 7,350,996 | B2 | 4/2008 | Bielecki et al. |
| 2002/0010510 | A1 | 1/2002 | Silvestrini |
| 2002/0029084 | A1 | 3/2002 | Paul et al. |
| 2002/0081139 | A1 | 6/2002 | Legg |
| 2002/0081232 | A1 | 6/2002 | Lewis et al. |
| 2002/0131807 | A1 | 9/2002 | Ami et al. |
| 2002/0142477 | A1 | 10/2002 | Lewis et al. |
| 2002/0159817 | A1 | 10/2002 | Brand et al. |
| 2002/0159818 | A1 | 10/2002 | Smith et al. |
| 2002/0172544 | A1 | 11/2002 | Dai |
| 2002/0192007 | A1 | 12/2002 | Lee |
| 2003/0068191 | A1 | 4/2003 | Hori |
| 2003/0108377 | A1 | 6/2003 | Duez et al. |
| 2003/0108743 | A1 | 6/2003 | Anderson |
| 2003/0138283 | A1 | 7/2003 | O'Brien et al. |
| 2003/0195300 | A1 | 10/2003 | Stevens et al. |
| 2003/0210945 | A1 | 11/2003 | Noguchi |
| 2003/0210947 | A1 | 11/2003 | calendrille et al. |
| 2003/0211130 | A1 | 11/2003 | Sanders et al. |
| 2003/0215281 | A1 | 11/2003 | Sexton et al. |
| 2003/0222048 | A1 | 12/2003 | Asakawa et al. |
| 2004/0028875 | A1 | 2/2004 | Van Rijn et al. |
| 2004/0037609 | A1 | 2/2004 | Kageyama |
| 2004/0050816 | A1 | 3/2004 | Asakawa et al. |
| 2004/0062879 | A1 | 4/2004 | Bowman et al. |
| 2004/0201117 | A1 | 10/2004 | Anderson |
| 2004/0213627 | A1 | 10/2004 | Marschand et al. |
| 2004/0265035 | A1 | 12/2004 | Brand et al. |
| 2004/0265039 | A1 | 12/2004 | Buck |
| 2005/0004578 | A1 | 1/2005 | Lambrecht et al. |
| 2005/0019112 | A1 | 1/2005 | Erickson et al. |
| 2005/0043470 | A1 | 2/2005 | Stevens et al. |
| 2005/0047844 | A1 | 3/2005 | Lammers et al. |
| 2005/0074268 | A1 | 4/2005 | Beil |
| 2005/0079003 | A1 | 4/2005 | Buck et al. |
| 2005/0084320 | A1 | 4/2005 | Carroll |
| 2005/0084321 | A1 | 4/2005 | Carroll |
| 2005/0089656 | A1 | 4/2005 | Shiina |
| 2005/0115690 | A1 | 6/2005 | Bohlig |
| 2005/0191112 | A1 | 9/2005 | Yoon |
| 2005/0196580 | A1 | 9/2005 | Provost et al. |
| 2005/0196583 | A1 | 9/2005 | Provost et al. |
| 2005/0208259 | A1 | 9/2005 | Provost et al. |
| 2005/0217092 | A1 | 10/2005 | Barker et al. |
| 2005/0221271 | A1 | 10/2005 | Murphy et al. |
| 2005/0246023 | A1 | 11/2005 | Yeung |
| 2005/0250181 | A1 | 11/2005 | Schroder Glad et al. |
| 2005/0256253 | A1 | 11/2005 | Parker et al. |
| 2005/0265774 | A1 | 12/2005 | Albisetti |
| 2005/0271451 | A1 | 12/2005 | Brand et al. |
| 2006/0002755 | A1 | 1/2006 | Sawa |
| 2006/0002757 | A1 | 1/2006 | Qiu |
| 2006/0002852 | A1 | 1/2006 | Saltzman et al. |
| 2006/0002971 | A1 | 1/2006 | Saltzman et al. |
| 2006/0004193 | A1 | 1/2006 | Muller et al. |
| 2006/0004314 | A1 | 1/2006 | McCarthy et al. |
| 2006/0019339 | A1 | 1/2006 | Lauth et al. |
| 2006/0036269 | A1 | 2/2006 | Schachar et al. |
| 2006/0051274 | A1 | 3/2006 | Wright et al. |
| 2006/0051451 | A1 | 3/2006 | Hutchinson et al. |
| 2006/0051735 | A1 | 3/2006 | Fuhr et al. |
| 2006/0058383 | A1 | 3/2006 | Huang et al. |
| 2006/0062780 | A1 | 3/2006 | Zocher et al. |
| 2006/0063882 | A1 | 3/2006 | Velev et al. |
| 2006/0065992 | A1 | 3/2006 | Hutchinson et al. |
| 2006/0069230 | A1 | 3/2006 | Papisov |
| 2006/0073159 | A1 | 4/2006 | Vonderheide et al. |
| 2006/0073294 | A1 | 4/2006 | Hutchinson et al. |
| 2006/0073298 | A1 | 4/2006 | Hutchinson et al. |
| 2006/0073333 | A1 | 4/2006 | Anderson |
| 2006/0084034 | A1 | 4/2006 | Hochman |
| 2006/0088897 | A1 | 4/2006 | Lim et al. |
| 2006/0095066 | A1 | 5/2006 | Chang et al. |
| 2006/0099244 | A1 | 5/2006 | Guilford |
| 2006/0106408 | A1 | 5/2006 | Schachar et al. |
| 2006/0106409 | A1 | 5/2006 | Schachar et al. |
| 2006/0110439 | A1 | 5/2006 | Tobia et al. |
| 2006/0115462 | A1 | 6/2006 | Subbotin et al. |
| 2006/0116712 | A1 | 6/2006 | Sepetka et al. |
| 2006/0116713 | A1 | 6/2006 | Sepetka et al. |
| 2006/0121608 | A1 | 6/2006 | Comer et al. |
| 2006/0147248 | A1 | 7/2006 | Fukui et al. |
| 2006/0216103 | A1 | 9/2006 | Bielecki et al. |

FOREIGN PATENT DOCUMENTS

| | | | |
|---|---|---|---|
| DE | 8900030 | U | 5/1990 |
| DE | 3341759 | A1 | 11/1997 |
| DE | 10326926 | A1 | 1/2005 |
| EP | 0 150 557 | | 8/1985 |
| EP | 0267557 | | 5/1988 |
| EP | 0 316 007 | | 5/1989 |
| EP | 0 400 272 | | 12/1990 |
| EP | 0 469 465 | | 2/1992 |
| EP | 0 545 917 | | 6/1993 |
| EP | 0 354 823 | | 2/1994 |
| EP | 0 586 792 | | 3/1994 |
| EP | 0 667 818 | | 8/1995 |
| EP | 0 703 096 | | 3/1996 |
| EP | 0 711 673 | | 5/1996 |
| EP | 0 822 098 | | 2/1998 |
| EP | 0 899 128 | | 3/1999 |
| EP | 1 050 417 | | 11/2000 |
| EP | 1 354 722 | A2 | 10/2003 |
| EP | 1 600 078 | | 11/2005 |
| GB | 243110 | | 11/1925 |
| GB | 937632 | | 9/1963 |
| GB | 2 325 649 | A | 12/1998 |
| JP | 58009788 | | 1/1983 |
| JP | 60119588 | | 6/1985 |
| JP | 1280596 | | 11/1989 |
| JP | 1281999 | | 11/1989 |
| JP | 2108086 | | 4/1990 |
| JP | 2283499 | | 11/1990 |
| JP | 4043345 | | 2/1992 |
| JP | 04316899 | | 11/1992 |
| JP | 6035232 | | 2/1994 |
| JP | 6216585 | | 8/1994 |
| JP | 07242094 | | 9/1995 |
| JP | 07290883 | | 11/1995 |
| JP | 07329486 | | 12/1995 |
| JP | 8072470 | | 3/1996 |
| JP | 8108676 | | 4/1996 |

| | | | |
|---|---|---|---|
| JP | 08216585 | | 8/1996 |
| JP | 8258480 | | 10/1996 |
| JP | 8282174 | | 10/1996 |
| JP | 8282175 | | 10/1996 |
| JP | 9131994 | | 5/1997 |
| JP | 10100579 | | 4/1998 |
| JP | 2003128971 | | 5/2003 |
| JP | 2003312185 | A | 11/2003 |
| JP | 2003312186 | A | 11/2003 |
| JP | 2003312188 | A | 11/2003 |
| KP | 2003056790 | A | 7/2003 |
| KP | 2003060260 | A | 7/2003 |
| KP | 2003061516 | A | 7/2003 |
| WO | WO-90/00118 | A1 | 1/1990 |
| WO | WO-93/12175 | | 6/1993 |
| WO | WO-93/17879 | | 9/1993 |
| WO | WO-94/11204 | | 5/1994 |
| WO | WO-94/11205 | | 5/1994 |
| WO | WO-94/25293 | | 11/1994 |
| WO | WO-95/07191 | | 3/1995 |
| WO | WO-96/39054 | | 12/1996 |
| WO | WO-98/06450 | | 2/1998 |
| WO | WO-99/11471 | | 3/1999 |
| WO | WO-01/28696 | | 4/2001 |
| WO | WO-01/64453 | | 9/2001 |
| WO | WO-02/06437 | | 1/2002 |
| WO | WO-02/13173 | | 2/2002 |
| WO | WO-02/064379 | | 8/2002 |
| WO | WO-03/068530 | | 8/2003 |
| WO | WO-2005/009755 | | 2/2005 |
| WO | WO-2007/097602 | A1 | 8/2007 |

OTHER PUBLICATIONS

Avery Office Products, "Retractable Whiteboard Markers," Avery Dennison Corporation (1996-2008), Retrieved from the Internet on Jun. 19, 2008: URL:<http://www.avery.com/us/Main?action=product.HierarchyList&node=10211090&catalogcode=WEB01.

Photograph A, Boone Marker, capped.

Photograph B, Boone Marker, uncapped.

Photograph C, Colorific Retractable Marker, retracted.

Photograph D, Colorific Retractable Marker, extended.

Photograph E, Marks-A-Lot Retractable Marker, retracted.

Photograph F, Marks-A-Lot Retractable Marker, extended.

Photograph G, Sharpie RT Marker, retracted.

Photograph H, Sharpie RT Marker, extended.

Photograph I, Tokai Retractable Marker, retracted.

Photograph J, Tokai Retractable Marker, extended.

International Search Report corresponding to co-pending International Patent Application Serial No. PCT/US2006/011014; European Patent Office; dated Nov. 23, 2006; 2 pages.

* cited by examiner

VALVE DOOR HAVING A FORCE DIRECTING COMPONENT AND RETRACTABLE INSTRUMENTS COMPRISING SAME

BACKGROUND

1. Field of the Disclosure

The disclosure relates generally to retractable instruments and more specifically to cap-less, retractable writing instruments having a valve door with a force directing component.

2. Related Technology

One example of a cap-less, retractable writing instrument is shown in U.S. Pat. No. 5,048,990, which is hereby incorporated by reference. The cap-less writing instrument includes a writing member having a writing tip. The writing member is accommodated in a seal cylinder that is disposed inside a writing instrument body. A seal cover for closing an end opening of the seal cylinder is disposed on the seal cylinder near the front end of the seal cylinder. A writing member moving mechanism moves the writing member forwardly and locks the writing member at a writing position with the writing tip protruding through the front of the writing instrument body. The moving mechanism includes a thread-like member that connects the writing member to the seal cover so that after the writing member is retracted, the seal cover is pulled backwardly so as to be brought into contact with the seal cylinder, thus preventing the writing tip from drying out. The prior art cap-less writing instruments work well with relatively small writing tips. However, the prior art design is not especially well suited for relatively large writing tips, for example, those used to produce markers intended to convey information to groups of people such as dry erase markers, and other similarly sized markers, as the seal cover does not adequately seal large diameter openings.

SUMMARY OF THE DISCLOSURE

A valve door for a retractable marker comprises a lid having first and second surfaces and a connecting means for connecting the lid with an actuating mechanism, the connecting means being adapted to distribute forces from the actuating mechanism across a portion of the first lid surface in order to bias the lid to a closed position. A force directing member is attached to the first lid surface, the force directing member being adapted to distribute force from the connecting means over a portion of the lid surface, thereby maintaining a positive seal and reducing lid deflection.

A retractable writing instrument comprises a writing member having a nib and a seal cylinder substantially surrounding the writing member, the seal cylinder having an open end. A movement mechanism moves the writing member from a retracted position in which the nib is disposed within the seal cylinder to an extended position in which the nib is extended outside of the seal cylinder through the open end. A lid is hingedly attached to the seal cylinder at the open end, the lid being movable between an open position in which the lid exposes the open end of the seal cylinder and a closed position in which the lid covers the open end of the seal cylinder. The lid includes a force directing member disposed on a lid surface opposite the open end of the seal cylinder. A connecting means is attached to the movement mechanism and the lid, the connecting means contacting the force directing member. The force directing member prevents the connecting means from contacting the first lid surface over at least a portion of the first lid surface.

A retractable writing instrument comprises a writing member having a nib, the writing member being disposed in a writing instrument body. A seal cylinder is disposed within the writing instrument body, the seal cylinder surrounding a portion of the writing member including the nib, and having an open end. A lid selectively seals or exposes the open end of the seal cylinder. A moving mechanism is disposed between the writing instrument body and the writing member, the moving mechanism moving the writing member between a retracted position in which the nib is disposed within the seal cylinder and an extended position in which the nib protrudes outside of the seal cylinder through the open end of the seal cylinder. A connecting means connects the lid to the moving mechanism, the connecting means applies force generated by the moving mechanism across at least a portion of one side of the lid, thereby biasing the lid to a closed position in which the lid seals the open end of the seal cylinder. The lid includes a pair of ribs positioned between the lid and the connecting means, the ribs elevating a portion of the connecting means above a portion of a lid surface distal to the seal cylinder, the pair of ribs applying force from the connecting means across a portion of the lid surface distal to the seal cylinder, thus reducing lid deflection when the lid is in the closed position and thereby reducing ink evaporation.

BRIEF DESCRIPTION OF THE DRAWINGS

Exemplary aspects and features of a writing instrument constructed in accordance with the disclosure are described and explained in greater detail below with the aid of the drawing figures in which.

DETAILED DESCRIPTION

Figure 1:
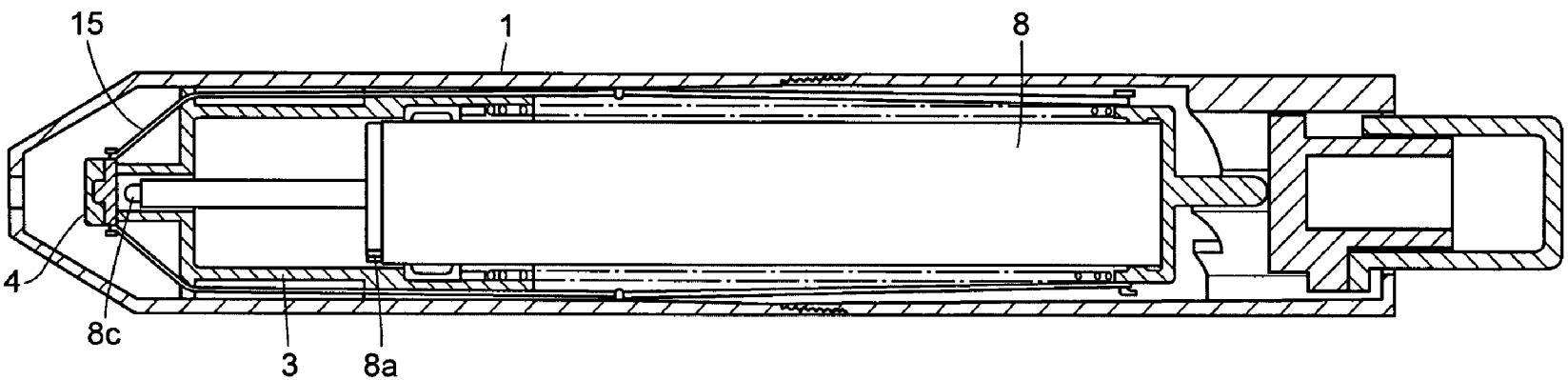
FIG. 1 is a cross-sectional view of a cap-less marker generally constructed in accordance with the teachings of the present disclosure, the marker having a seal door in a closed position.
Figure 2:
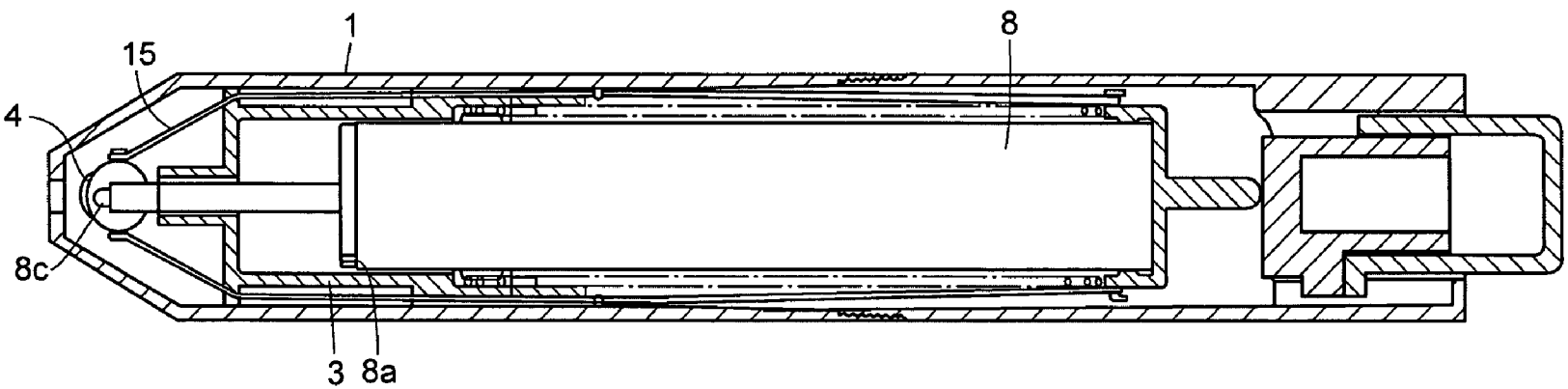
FIG. 2 is a cross-sectional view of the cap-less marker of FIG. 1 having the seal door in an open position.

A writing instrument generally constructed in accordance with the teachings of the disclosure is shown in FIGS. 1 and 2. The writing instrument includes a body 1 that houses a seal cylinder 3. A writing member 8 is partially disposed within the seal cylinder 3. The writing member 8 includes a writing tip 8*c* that is movable through an opening in the seal cylinder 3 (FIG. 1 illustrates the writing instrument in a retracted position and FIG. 2 illustrates the writing instrument in an extended position). An air hole 8*a* is disposed in the body 1 that allows equalization of pressure within the seal cylinder. A seal cover 4 closes the open end of the seal cylinder 3 when the writing tip 8*c* is retracted. A connecting means 15, such as a string connects the writing member 8 to the seal cover 4. The connecting means 15 may be flexible or semi-rigid. The semi-rigid connecting means may include a geometric feature that locates and directs bending movement in a predictable manner. When the writing member 8 is retracted into the seal cylinder 3, the connecting means 15, under tension, pulls the seal cover 4 into a closed position, thus preventing the writing tip 8*c* from drying out.

Figure 3:
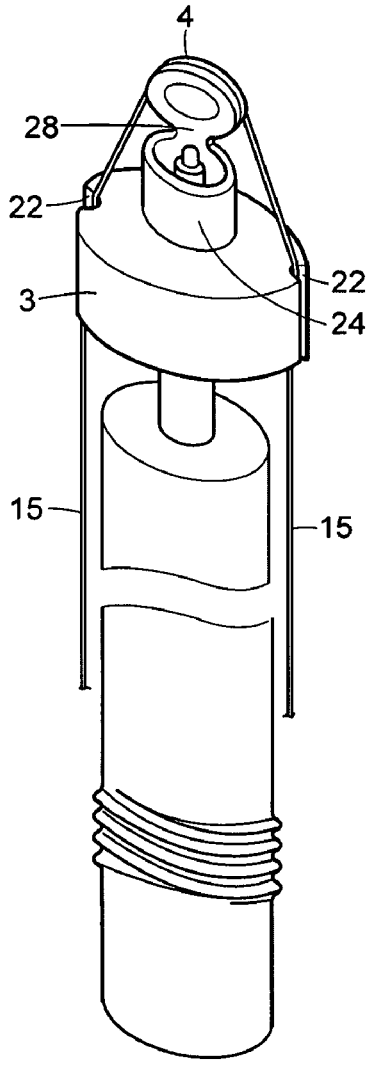
FIG. 3 is a perspective view of a portion of a valve cylinder and connecting means of the cap-less marker of FIG. 1.

The seal cylinder 3 may include grooves 22 (FIG. 3), through which the connecting means 15 pass and are retained. An upper portion 24 of the seal cylinder 3 includes an opening that is selectively sealed by the seal cover 4. The seal cover 4 is connected to the seal cylinder 3 by a hinge 28. The hinge 28 is typically a living hinge and molded integrally with the seal cylinder 3 and seal cover 4.

Prior art seal covers 4 often included a groove 32 (FIG. 4) formed in the outer (or top) surface of the seal cover 4. The groove 32 locates and stabilizes the connecting means 15 across the seal cover 4 and prevents the connecting means 15 from sliding off of the seal cover 4, but does not elevate the connecting means 15 relative to the seal cover 4. The groove 32 includes features that are oriented in a direction substantially parallel to the direction of the connecting means 15 across the seal cover 4.

Typically, the seal cover 4 is subjected to an internal pressure in the closed position due, in part, to solvent vapor pressure within the seal cylinder 3. A force from the connecting means 15 counteracts the internal pressure when the seal cover 4 is in the closed position, thus forming a seal between the seal cover 4 and the seal cylinder 3. The seal between the seal cover 4 and the seal cylinder 3 prevents or reduces premature solvent loss within the writing system, and thereby mitigates dry out of the writing instrument by substantially sealing the assembly.

Figure 4:
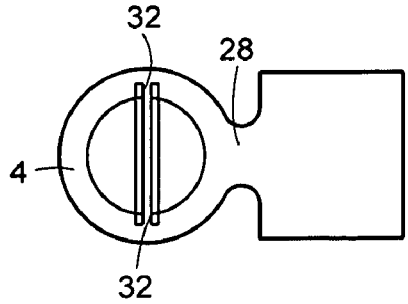
FIG. 4 PRIOR ART
FIG. 4 is a top plan view of a prior art valve door.

We have observed that prior art seal covers 4, such as the seal cover 4 shown in FIG. 4, often begin to deform in the closed position due, in part, to a diameter of the seal cover 4, materials used to form the seal cover 4, a force applied to the seal cover 4 by the connecting means 15, and/or the internal pressure exerted against the seal cover 4 from inside the seal cylinder 3. Such seal cover deformation can create leaks in the interface between the seal cover 4 and the seal cylinder 3, and thereby cause premature drying of the writing tip (despite the seal formed between the seal cover 4 and the seal cylinder 3).

Figure 5:
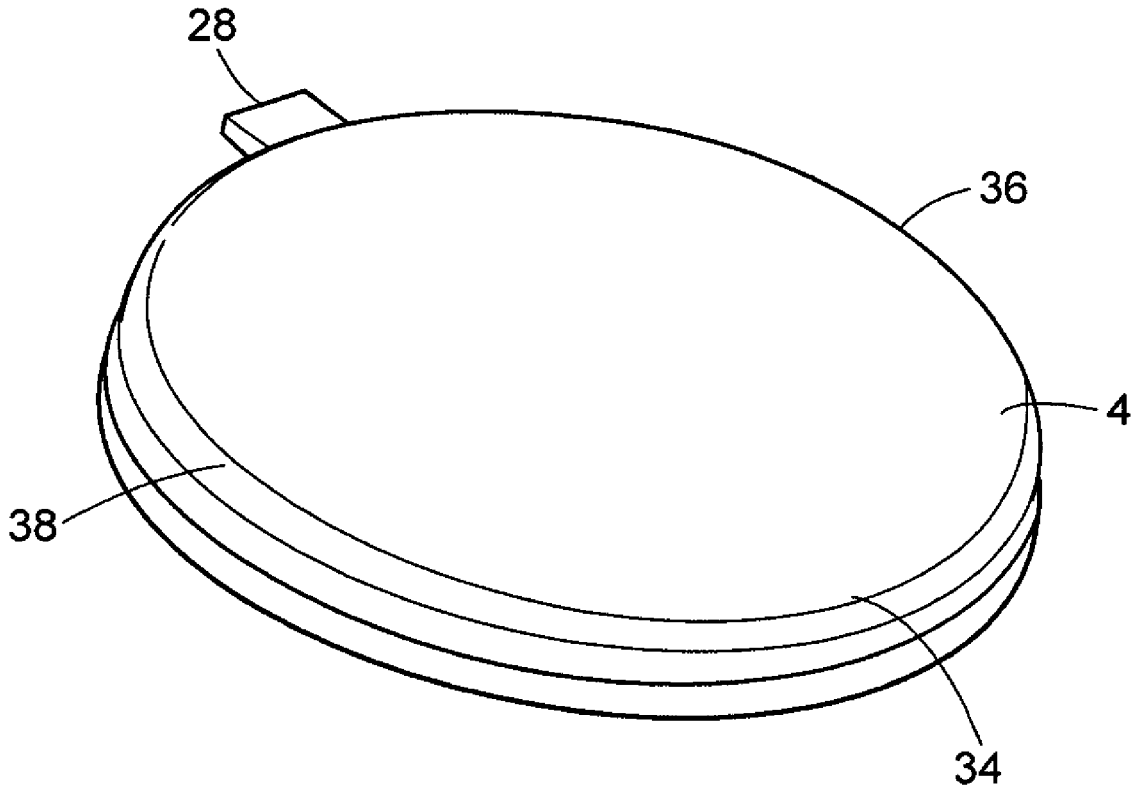
FIG. 5 PRIOR ART
FIG. 5 is a perspective view of another embodiment of a prior art valve door.

Turning now to FIG. 5, another prior art seal cover 4 is shown in a closed position. We have observed that the prior art seal covers 4 shown in FIGS. 4 and 5 experience displacements due to a bending or bowing of the seal cover 4 over time. These displacements are believed to be due, in part, to the load applied to the top of the seal cover 4 by the connecting means 15 and the internal solvent vapor pressure applied to the bottom of the seal cover 4. Without intending to be bound by theory, it is believed that the linear nature of the connecting means 15 often causes the seal cover 4 to bow or deform downwardly, into the seal cylinder 3 (referred to hereinafter as a "negative displacement"), adjacent the connection means 15. Similarly, it is believed that that the seal cover 4 deflects upwardly away from the seal cylinder 3 (referred to hereinafter as a "positive displacement") at regions distal to the connecting means 15 (i.e., the front 34 of the seal cover 4). As a result, prior art seal covers 4 often leak in the vicinity of the front 34 of the seal cover 4, thereby causing premature drying of the writing tip. This problem is particularly acute when the seal cover 4 and the seal cylinder 3 are made larger to accommodate larger writing points and/or other relatively larger sized instruments.

Figure 6A:
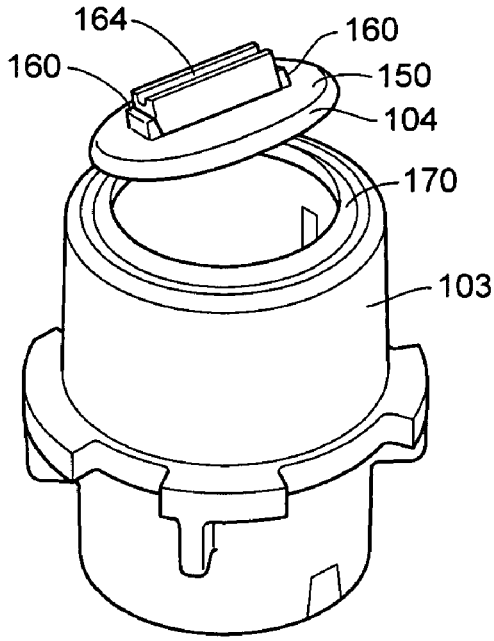
FIGS. 6A and 6B are perspective views of a lid and seal cylinder constructed in accordance with the teachings of the disclosure with the lid in a partially open position and a fully open position, respectively.
Figure 6B:
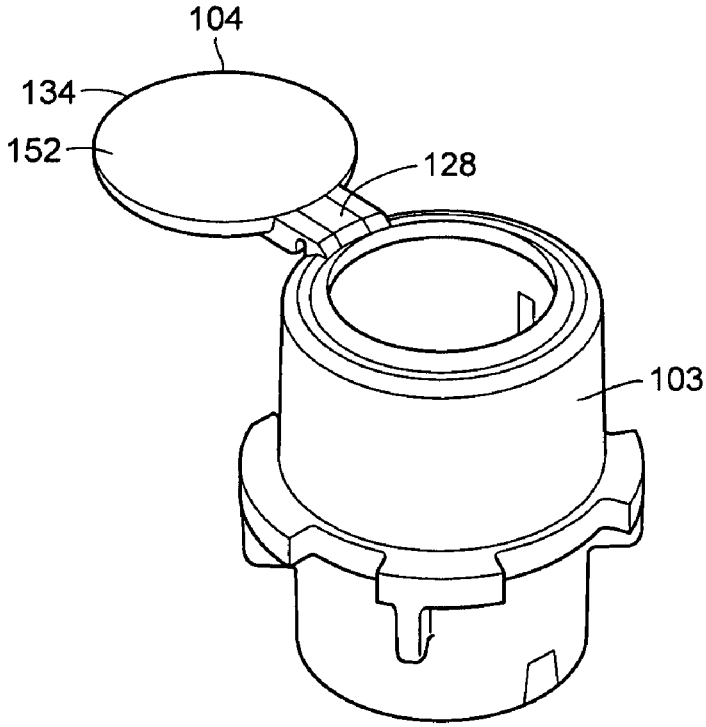

As shown in FIGS. 6A and 6B, a lid 104 for a retractable writing instrument constructed in accordance with the teachings of the disclosure includes a first (upper) surface 150, a second (lower) surface 152, and a hinge 128, which may be an integrally molded living hinge, or a dual component living hinge as described in U.S. patent application Ser. No. 11/654,959, which is hereby incorporated herein by reference. The hinge 128 connects the lid 104 to seal cylinder 103. The seal cylinder 103 may be a single component seal cylinder, or a dual component seal cylinder, such as the seal cylinder described in U.S. patent application Ser. No. 11/654,959. A connecting means (not shown) extends across the first surface 150 of the lid 104. The connecting means connects the lid 104 to an actuating or moving mechanism (not shown). The actuating mechanism selectively extends the writing tip outwards, through an opening in the seal cylinder 103 and retracts the writing tip inwards, into the seal cylinder 103 upon actuation. Alternatively, or in addition to the foregoing, the actuating mechanism can actuate the lid 104 from an open position to a closed position. The lid 104 also includes a force directing member, such as a pair of ribs 160. In the embodiment of FIGS. 6A and 6B, the ribs 160 are parallel to one another. However, the ribs 160 need not be oriented parallel to one another. The pair of ribs 160 elevates the connecting means above the first surface 150 and distributes force generated by the connecting means over or through a portion of the first surface 150. An additional benefit of the pair of ribs 160 is that the pair of ribs 160 may effectively increase the structural rigidity of the lid 104. Thus, the pair of ribs 160 reduces both positive and negative deflection of the lid 104 in the closed position by both distributing the load of the connecting means toward the center of the lid 104 and strengthening the lid 104.

The pair of ribs 160 may be formed of plastic and the may be attached to the first surface 150 by any known means, such as adhesive, fasteners, integral molding, etc. Although the ribs 160 need not be parallel to one another, the ribs 160 typically are oriented in a direction substantially parallel to one another, for example, in a direction parallel to the line between the hinge 128 and the front 134 of the lid 104.

Figure 6C:
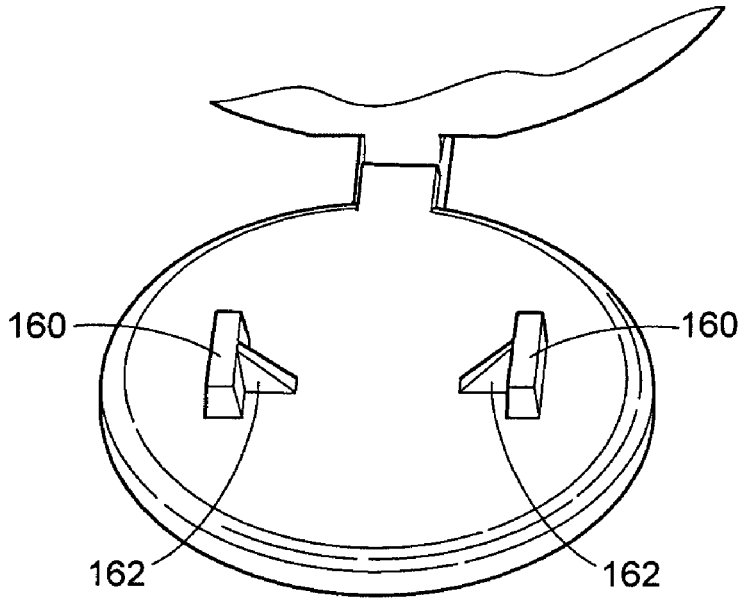
FIG. 6C is a perspective view of the lid of FIGS. 6A and 6B with a connection means retention feature removed.

Each of the pair of ribs 160 may include a gusset 162 (FIG. 6C), typically oriented substantially perpendicular to the rib 160 to stabilize and strengthen each rib 160 on the first surface 150. A connecting means retention feature, such as a block and channel 164 may be disposed between the ribs 160 to center and retain the connecting means. The connecting means retention feature 164 may be formed of a different material from the lid 104 and ribs 160, if desired. For example, the connecting means retention feature may be formed of an elastomer because forces from the connecting means need not be transmitted through the connecting means retention feature 164 to the lid 104. Rather, the ribs 160 direct substantially all of the forces and thus are essentially the sole force directing members. In this embodiment, a top surface of each rib 160 may be elevationally located between the connecting means retention feature 164 and the first lid surface 150; for example, the top surface of each rib 160 may be located at substantially the same elevation as the bottom of the channel, groove, or other retention element in the connecting means retention feature 164. The connecting means retention feature 164 prevents lateral movement of the connecting means across the top surfaces of the ribs 160 while positioning the connecting means to contact the ribs 160 in a fashion that maximizes their force directing capabilities.

A valve seal ring 170 may be disposed on the seal cylinder 103, for example, on an interior annular surface proximate the opening of the seal cylinder 103. The valve seal ring 170 contacts the second surface 152 of the lid 104 (which is opposite the first surface 150) when the lid 104 is in a closed position and thus can help in sealing the assembly. The valve seal ring 170 may be formed of the same material as the seal cylinder 103 (e.g., a single shot molding process), or the valve seal ring 170 may be formed of a different material from the seal cylinder 103 (e.g., a two shot molding process as described in U.S. patent application Ser. No. 11/654,959).

By directing force from the connection means towards the center of the lid 104, it is believed that the force directors 160 cause the lid 104 to deform in a predictable manner. For example, when the lid 104 deforms, the deformation radiates outward from the center in a negative direction (i.e., into the valve cylinder). Additionally, the greatest negative deformation generally occurs near the center of the lid 104 with the negative deformation decreasing exponentially toward the outer circumference of the lid 104. Thus, the valve seal ring 170 remains under positive compression over its entire circumference, especially the area adjacent the front 134 of the lid 104. As a result, the lid 104 reduces premature evaporation of ink solvent when the lid 104 is in the closed position by maintaining positive pressure across the entire valve seal ring 170.

The cross-section or width of the ribs 160 is relatively small compared to the thickness of the lid 104. Thus, injection molding defects, such as sink marks or surface imperfections, are significantly reduced due to a large injection pressure drop across the relatively small hinge gate. As a result, defects on the lid 104 that would reduce seal integrity between the lid 104 and the valve seal ring 170 are greatly reduced.

Figure 7:
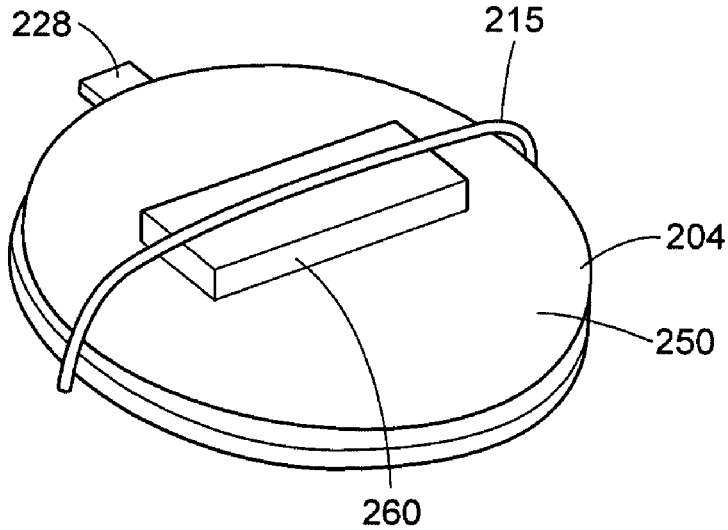
FIG. 7 is a perspective view of a first alternate embodiment of a lid constructed in accordance with the teachings of the disclosure.

A second alternate embodiment of a lid 204 constructed and arranged in accordance with teachings of the disclosure is shown in FIG. 7. In the second embodiment, the force directing means takes the form of a block 260. The connecting means 215 extends across the first surface 250 of the lid 204 and across the block 260. Thus, the block 260 elevates the connecting means 215 above the first surface 250 of the lid 204 and directs the force from the connecting means 214 through the lid 204 and substantially inside the diameter of the valve seal ring 170 (FIG. 6B). The block 260 may optionally include a groove, channel, or similar retention features(s) (not shown) to help retain the connecting means 215 therein. As in other embodiments, the force directing component 260 elevates the connecting means above a least a portion of the first surface 250, and the connecting means 215 is disposed transversely to a hinge 228 for opening/closing the valve assembly (not shown). The block 260 may be formed of plastic or any other suitable material. The block 260 may be attached to the first surface 250 by any known means, such as adhesive, fasteners, integral molding (e.g., single or double shot molding processes), etc.

Figure 8:
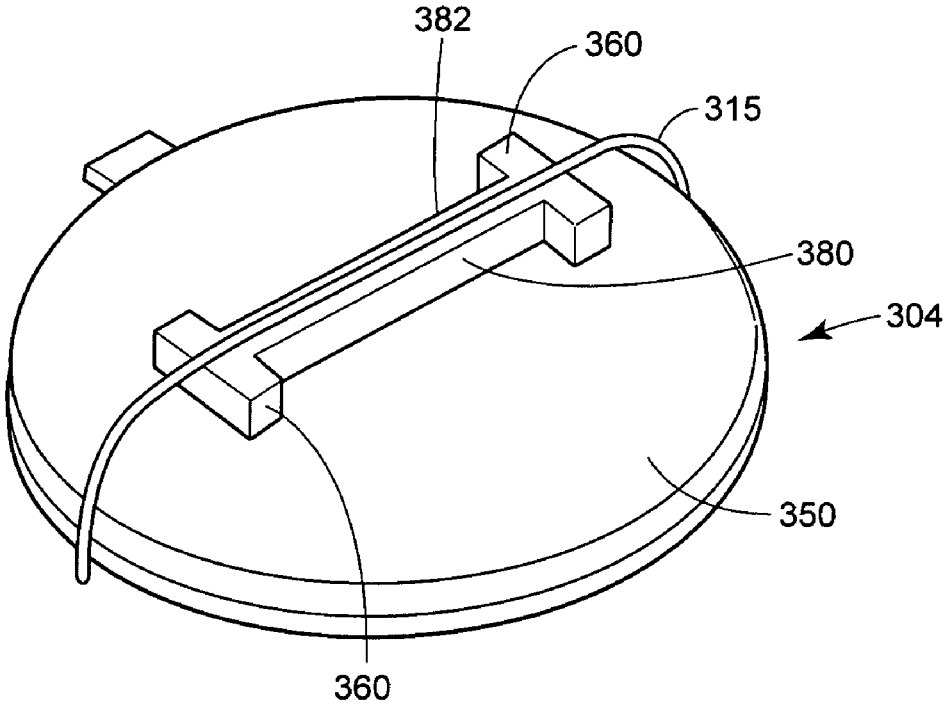
FIG. 8 is a perspective view of a second embodiment of a lid constructed in accordance with the teachings of the disclosure.

A third alternate embodiment of a lid 304 is shown in FIG. 8. In the third embodiment, a bridge 380 is provided between the two ribs 360 on the first lid surface 350. The bridge 380 may optionally include a retention feature such as a groove or channel 382 for positioning and stabilizing the connecting means 315 across lid surface 350, thereby maintaining the connecting means 315 in a desired orientation across the lid 304.

In yet another embodiment, the force director could be provided as a single elevated structure positioned substantially in the center of the lid, thereby forming a tower. The tower centrally distributes the forces from the connecting member across the top of the lid, and substantially inside the diameter of the seal.

In still another embodiment, the force directing member could be attached to the connecting member as opposed to being attached to the lid. When the connecting member is positioned on the top of the lid such that the force directing member is substantially at the center thereof, the force directing member would contact the top of the lid, thus distributing forces from the transfer member across the top of the lid, and substantially inside the diameter of the seal.

In each of the above embodiments, it is believed that the force directing member redirects forces from the connecting member towards the center of the lid, thus causing the lid to cup, or deflect inwardly from the center of the lid. This deflection causes a more even distribution of force across a valve seal ring on a seal cylinder. Moreover, causing the lid to deflect in the center prevents asymmetric edge deflections that could cause leaks, thereby compromising the ink system of a retractable marker.

The force directors may be used on virtually any instrument having a lid. For example, as will be appreciated by one of skill in the art, valve doors having a force director as described above may be used in various retractable writing instruments such as highlighters, markers, felt-tipped pens, ball point pens, and the like. In addition to writing instruments, the force directors are also applicable to a variety of other retractable instruments including paint brush applicators, correction fluid applicators, make-up applicators, such as nail polish and mascara applicators, perfume applicators, thermometers, pH detectors, knives, fluid sampling devices, and other instruments. The improved valve door is particularly useful for writing instruments such as retractable markers having relatively large writing points as such instruments greatly benefit from the improved seal achieved with the force director components described herein. In one aspect, the writing instrument is a permanent marker. In another aspect, the writing instrument is a dry-erase marker.

Although certain force directors have been described herein in accordance with the teachings of the present disclosure, the scope of coverage of this patent is not limited thereto. On the contrary, while the invention has been shown and described in connection with various preferred embodiments, it is apparent that certain changes and modifications, in addition to those mentioned above, may be made. This patent covers all embodiments of the teachings of the disclosure that fairly fall within the scope of permissible equivalents. For example, the force director may take on virtually any shape and/or size provided that it is capable of directing force as described herein. Many other variations of the invention may also be used without departing from the principles outlined above. Accordingly, it is the intention to protect all variations and modifications that may occur to one of ordinary skill in the art.

What is claimed is:

1. A valve door for an instrument comprising:

a lid having a first lid surface and a second lid surface;

a means for connecting the lid with an actuating mechanism, the means for connecting being adapted to transmit force from the actuating mechanism to the first lid surface, the means for connecting extending across the first lid surface; and a force directing member attached to the first lid surface, the force directing member elevating the means for connecting above a portion of the first lid surface, thereby preventing the means for connecting from contacting the first lid surface over at least a portion of the first lid surface and distributing force from the means for connecting across a portion of the first lid surface, wherein the force directing member comprises two ribs, the two ribs being spaced apart from one another and connected by a bridge, the bridge including a retention feature for positioning the means for connecting across the bridge, and wherein the upper surface of each of the ribs is elevationally disposed between the retention feature and the lid.

2. The valve door of claim 1 wherein the lid has a circular perimeter.

3. The valve door of claim 1 wherein the force directing member is attached to the first lid surface with an adhesive or a fastener, or is integrally molded with the lid.

4. The valve door of claim 1 wherein each rib includes a gusset.

5. The valve door of claim 1 wherein the two ribs are oriented substantially perpendicular to the means for connecting.

6. The valve door of claim 1 wherein each rib includes a channel for positioning the means for connecting across the first lid surface.

7. The valve door of claim 1 further comprising a hinge adapted to attach the lid to a seal cylinder.

8. The valve door of claim 1 wherein the means for connecting is a string.

9. The valve door of claim 1 wherein the instrument is a highlighter, a marker, a felt-tipped pen, a ball point pen, a paint brush applicator, a correction fluid applicator, a make-up applicator, a perfume applicator, a thermometer, a pH detector, a knife, or a fluid sampling device.

10. The valve door of claim 1, wherein the two ribs are oriented substantially parallel to one another and substantially parallel to a line between a hinge and a front of the lid.

11. The valve door of claim 1, wherein the valve door is disk-shaped and the first lid surface and the second lid surface are located on opposite sides of the valve door.

12. A retractable writing instrument comprising;

a writing member having a nib;

a seal cylinder substantially surrounding the writing member, the seal cylinder having an open end;

a movement mechanism that moves the writing member from a retracted position in which the nib is disposed within the seal cylinder to an extended position in which the nib is extended outside of the seal cylinder through the open end;

a lid hingedly attached to the seal cylinder at the open end, the lid being movable from an open position in which the lid exposes the open end of the seal cylinder to a closed position in which the lid covers the open end of the seal cylinder, the lid including a force directing member disposed on a first lid surface opposite the open end of the seal cylinder, the force directing member extending outward away from the first lid surface and away from the seal cylinder; and a means for connecting the movement mechanism to the lid, wherein the means for connecting extends across the first lid surface and contacts the force directing member, the force directing member elevating the means for connecting above at least a portion of the first lid surface, thereby preventing the means for connecting from contacting at least a portion of the first lid surface.

13. The retractable writing instrument of claim 12 wherein the force directing member comprises two ribs.

14. The retractable writing instrument of claim 13 wherein a bridge connects the two ribs.

15. The retractable writing instrument of claim 12 wherein each rib comprises a gusset.

16. The retractable writing instrument of claim 12 comprising a valve seal ring disposed on the open end of the seal cylinder.

17. The retractable writing instrument of claim 16 wherein the valve seal ring is integrally formed with the seal cylinder in a single shot molding process.

18. A retractable writing instrument comprising:

a writing member having a nib, the writing member being disposed in a writing instrument body;

a seal cylinder disposed within the writing instrument body, the seal cylinder surrounding a portion of the writing member including the nib, the seal cylinder having an open end;

a lid for selectively sealing the open end of the seal cylinder, the lid having a first lid surface;

a moving mechanism disposed between the writing instrument body and the writing member, the moving mechanism adapted to move the writing member between a retracted position in which the nib is disposed within the seal cylinder and an extended position in which the nib protrudes outside of the seal cylinder through the open end of the seal cylinder; and a means for connecting the lid to the moving mechanism, the means for connecting extending across the first lid surface and distributing a portion of a force generated by the moving mechanism across the first lid surface, thereby biasing the lid to a closed position in which the lid seals the open end of the seal cylinder, wherein the first lid surface includes a pair of ribs extending away from the first lid surface and away from the seal cylinder, the pair of ribs being positioned between the first lid surface and the means for connecting, thereby elevating a portion of the means for connecting above the first lid surface, the pair of ribs distributing force from the means for connecting across a portion of the first lid surface, thus reducing lid deflection when the lid is in the closed position and thereby reducing ink evaporation.

* * * * *

UNITED STATES PATENT AND TRADEMARK OFFICE

CERTIFICATE OF CORRECTION

PATENT NO. : 8,226,312 B2
APPLICATION NO. : 12/057477
DATED : July 24, 2012
INVENTOR(S) : Rennecker et al.

It is certified that error appears in the above-identified patent and that said Letters Patent is hereby corrected as shown below:

In the Claims

In Column 7, Line 40, in Claim 12, please delete "comprising;" and insert -- comprising: --, therefor.

In Column 8, Line 15, in Claim 15, please delete "claim 12" and insert -- claim 13 --, therefor.

Signed and Sealed this
First Day of March, 2016

Michelle K. Lee

Michelle K. Lee
*Director of the United States Patent and Trademark Office*